US007446723B2

(12) United States Patent
Osaka et al.

(10) Patent No.: US 7,446,723 B2
(45) Date of Patent: Nov. 4, 2008

(54) LINEAR ACTUATOR

(75) Inventors: Tadashi Osaka, Kashiwa (JP); Kazushi Yoshida, Kasumigaura (JP); Ryoko Ichinose, Tsukuba (JP)

(73) Assignee: Hitachi, Ltd., Tokyo (JP)

( * ) Notice: Subject to any disclaimer, the term of this patent is extended or adjusted under 35 U.S.C. 154(b) by 330 days.

(21) Appl. No.: 11/480,910

(22) Filed: Jul. 6, 2006

(65) Prior Publication Data

US 2007/0008230 A1 Jan. 11, 2007

(30) Foreign Application Priority Data

Jul. 6, 2005 (JP) ..... 2005-196952

(51) Int. Cl.
*H01Q 3/00* (2006.01)
*H01Q 21/00* (2006.01)
*H01Q 1/10* (2006.01)

(52) U.S. Cl. ..... 343/766; 343/879; 343/901

(58) Field of Classification Search ..... 343/702, 343/757, 766, 878, 879, 893, 901
See application file for complete search history.

(56) References Cited

U.S. PATENT DOCUMENTS 5,150,770 A * 9/1992 Secci ..... 185/40 R
6,831,393 B2 * 12/2004 Miyazawa ..... 310/323.14

FOREIGN PATENT DOCUMENTS

JP 11-264451 9/1999

* cited by examiner

*Primary Examiner*—Shih-Chao Chen
(74) *Attorney, Agent, or Firm*—Antonelli, Terry, Stout & Kraus, LLP.

(57) ABSTRACT

Disclosed is a linear actuator, including: a screw unit rotatably driven by a driving motor; a nut unit screwed to the screw unit; a slider attached to the nut unit, in which the slider and the nut unit move linearly by the rotation of the screw unit; a guide restricting both surfaces of the slider; a first antenna attached to a side wall of the guide opposite to the slider; a second antenna attached to a side wall of the guide opposite to the slider, and opposing the first antenna; and a third antenna attached to both side walls of the slider, being interposed between the first antenna and the second antenna, wherein position of the slider is detected based on a change in capacitance due to displacement of the third antenna with respect to the first antenna and the second antenna.

6 Claims, 12 Drawing Sheets

LINEAR ACTUATOR

CLAIM OF PRIORITY

The present application claims priority from Japanese application JP 2005-196952 filed on Jul. 6, 2005, the content of which is hereby incorporated by reference into this application.

BACKGROUND OF THE INVENTION

1. Field of the Invention

The present invention is related to a linear actuator.

2. Description of the Related Art

A linear actuator converts a rotational motion into a linear motion. For example, Japanese Patent Laid-Open. No. H11 (1999)-264451 introduced a linear actuator, which converts the rotational motion of a motor mounted on the main body into the linear motion by a power transmission mechanism which comprises a feed screw unit driven in rotation via the motor and a feed nut unit screwed to the feed screw unit, thereby moving linearly the actuation member in the axial direction of the feed screw unit. In addition, Japanese Patent Laid-Open No. 2002-58271 disclosed a linear servo actuator capable of detecting the position of a slider with high accuracy.

To this end, the linear servo actuator comprises a magnetostriction potentiometer for detecting the position of a slider, and a position control unit in charge of feed back control of the position of the slider based on the difference between the position of the slider and a command position.

However, these conventional techniques have the following problems.

For instance, the linear actuator disclosed in Japanese Patent Laid-Open No. H11(1999)-264451 is not equipped with a position sensor for detecting the position of an actuation member. Thus, to execute the positioning of the actuation member, a sensor has to be installed additionally.

On the other hand, the linear servo actuator disclosed in Japanese Patent Laid-Open No. 2002-58271 is equipped with a magnetostriction potentiometer as a position sensor for detecting the position of the slider. The magnetostriction potentiometer comprises a magnetostriction scale and a magnetostriction head. Since the magnetostriction scale was mounted on a platen which is a fixed member and the magnetostriction head on the slider formed movably on the platen, the overall actuator size became too large. In addition, an expensive linear pulse motor implemented as a driving motor increased the price of the actuator.

SUMMARY OF THE INVENTION

It is, therefore, an object of the present invention to provide a compact, high precision linear actuator.

To achieve the above objects and advantages, there is provided a linear actuator, including: a screw unit rotatably driven by a driving motor; a nut unit screwed to the screw unit; a slider attached to the nut unit, in which the slider and the nut unit move linearly by the rotation of the screw unit; a guide restricting both surfaces of the slider; a first antenna attached to a side wall of the guide opposite to the slider; a second antenna attached to a side wall of the guide opposite to the slider, and opposing the first antenna; and a third antenna attached to both side walls of the slider, being interposed between the first antenna and the second antenna, wherein position of the slider is detected based on a change in capacitance due to displacement of the third antenna with respect to the first antenna and the second antenna.

In an exemplary embodiment of the invention, the second antenna is grounded and the linear actuator of claim further comprises an oscillatory circuit applying a radio frequency AC voltage to the first antenna, a resistor connected between the oscillatory circuit and the first antenna, a signal processing circuit processing a signal from the first antenna, and a control unit calculating the position of the slider based on the signal from the signal processing circuit and controlling the drive of the driving motor.

In an exemplary embodiment of the invention, capacitance of a first condenser formed by the first antenna and the third antenna, capacitance of a second condenser formed by the second antenna and the third antenna, and capacitance of a third condenser formed by the first antenna and the second antenna change by a movement of the slider, and the position of the slider with respect to the guide is calculated by detecting from the oscillatory circuit a change in the AC voltage applied to the first antenna.

In an exemplary embodiment of the invention, the third antenna is formed of a conductor being bent to oppose the first antenna and the second antenna in continuation.

Another aspect of the invention provides a linear actuator, including: a rotating bar driven by a driving motor; a spiral spring screwed to the rotating bar; a slider attached to the spiral spring; and a guide accommodating the slider and the spiral spring, wherein the spiral spring and the slider move linearly inside the guide by the rotation of the rotating bar; the linear actuator further includes: a first antenna installed in a longitudinal direction of the guide; an second antenna, which is installed on the guide in a manner to be faced with the first antenna and which is grounded; a third antenna attached to the slider opposing the first antenna and the second antenna; an oscillatory circuit applying a radio frequency AC voltage to the first antenna; a resistor connected between the oscillatory circuit and the first antenna; a signal processing circuit processing a signal from the first antenna; and a control unit calculating the position of the slider based on the signal from the signal processing circuit and controlling the drive of the driving motor.

The linear actuator of the invention detects a displacement amount of the slider with respect to the guide in case the driving motor is OFF, and calculates an external force applied to the slider by utilizing the displacement amount and a spring constant of the spiral spring.

BRIEF DESCRIPTION OF THE DRAWINGS

The above aspects and features of the present invention will be more apparent by describing certain embodiments of the present invention with reference to the accompanying drawings, in which.

DETAILED DESCRIPTION OF THE PREFERRED EMBODIMENTS

The preferred embodiments of the present invention will be described herein below with reference to the accompanying drawings in FIGS. 1 to 16.

A linear actuator of the invention converts the rotational motion of a driving motor into the linear motion using a feed screw unit, thereby moving an article linearly. Particularly, the present invention realizes a compact (i.e., small outer diameter), cost-effective linear actuator.

Embodiment I

Figure 1:
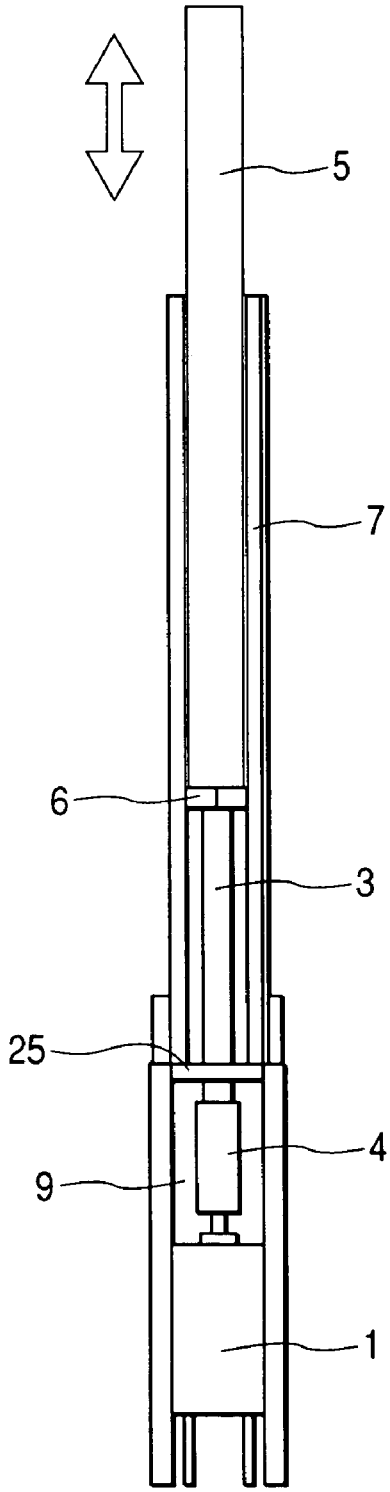
FIG. 1 is a front view illustrating a constitution of a linear actuator according to a first embodiment of the present invention.
Figure 2:
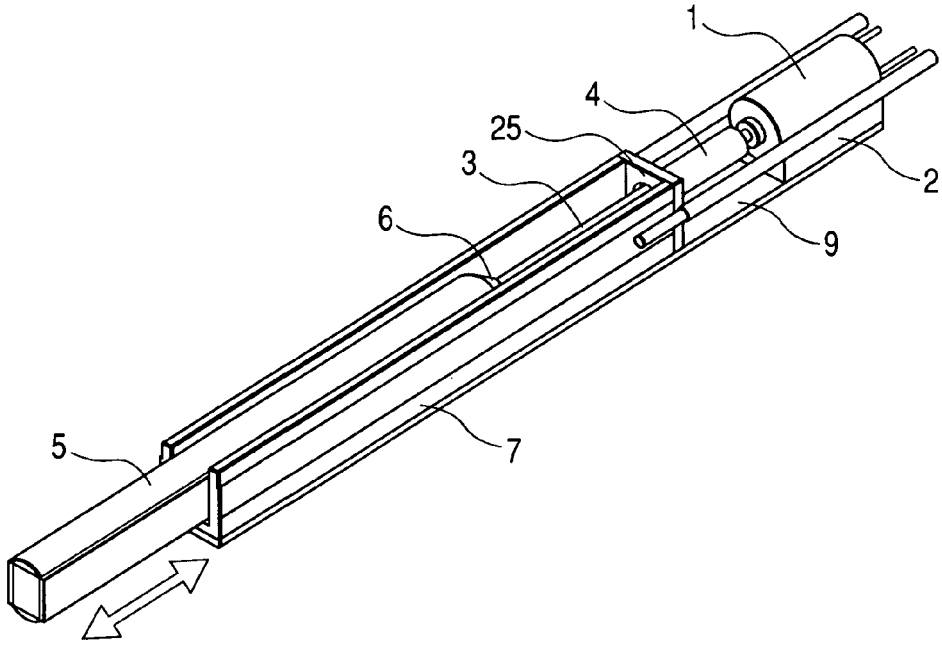
FIG. 2 is a perspective view of the embodiment of FIG. 1.

FIG. 1 is a front view illustrating a constitution of a linear actuator according to a first embodiment of the present invention, and FIG. 2 is a perspective view of the embodiment of FIG. 1.

As shown in FIGS. 1 and 2, the linear actuator includes a driving motor 1 as a driving power source of a slider 5. In the drawings, reference numeral 2 denotes a driving motor holder for fixing the driving motor 1. Reference numeral 3 denotes a feed screw unit connected to the driving motor 1, rotating together with the drive of the driving motor 1. Reference numeral 4 denotes a joint connecting the driving motor 1 and the feed screw unit 3. Reference numeral 6 denotes a feed nut unit, which is screwed to the slider 5 for linearly moving to move an article and the feed screw unit 3, to convert a rotational motion into a linear motion. Reference numeral 7 denotes a guide guiding the slider 5 to move in a straight line by preventing the rotation of the slider 5. Reference numeral 8 denotes a displacement sensor (not shown in FIGS. 1 and 2 but will be described later with reference to FIG. 4), which measures a displacement amount of the slider 5. Reference numeral 9 denotes a base on which the driving motor holder 2 and the guide 7 are mounted. Reference numeral 10 denotes a control unit (not shown in FIGS. 1 and 2 but will be described later with reference to FIG. 4), which controls driving of the linear actuator. Reference numeral 25 denotes a second stopper. The second stopper 25 is deposited at the end portion on the side of driving motor 1 of the guide 7. The second stopper 25 has a hole into which the feed screw unit 3 is inserted. Thus, an inner diameter of the hole should be slightly larger than an outer diameter of the feed screw unit 3 so as to prevent frictional resistance therebetween. The second stopper 25 restricts the movement of the slider 5 and the feed nut unit 6, which move together with the driving motor 1, towards the driving motor 1.

An example of the driving motor 1, the driving power source, is a DC brush motor. Although a stepping motor offering easy position control or a DC brushless motor may be used as the driving motor 1, an inexpensive DC brush motor is preferred for the sake of saving cost. In addition, to increase thrust of the linear actuator, a reduction gear may be attached to the driving motor 1. To realize a compact linear actuator, however, the outer diameter of the reduction gear must be smaller than the outer diameter of the driving motor 1. The driving motor holder 2 is used for fixing the driving motor 1 to the base 9. With help of the driving motor holder 2, the driving motor 1 is installed in a manner that the output shaft of the driving motor 1 is parallel to the base 9. As for the feed screw unit 3, screw grooves are formed in almost the entire area of its outer peripheral surface. The feed screw unit 3 is connected to the output shaft of the driving motor 1 by a joint 4. In detail, the center axis line of the output shaft of the driving motor 1 and the center axis line of the feed screw unit 3 are installed on the same line. The feed screw unit 3, being connected to the driving motor 1 through the interposition of the joint 4 therebetween, rotates together with the output shaft of the driving motor 1. Moreover, the length of the feed screw unit 3 is set to be greater than the stroke of the slider 5. The feed screw unit 3 is made of hard metals, stainless steel for example, so that it may not be easily bent. Although thrust of the linear actuator increases as the pitch of the screw groove of the feed screw unit 3 decreases, the moving speed of the slider 5 slows down.

Meanwhile, it is necessary to set a proper pitch according to specifications required of a linear actuator. Even though a coupling for example is used for the joint 4, other things can also be utilized as long as they generate the same effect. The slider 5 has a tubular shape, not a circular cylindrical shape, and at least one surface thereof is planar. In case of the slider 5 shown in FIG. 2, there are two planar surfaces in order to install a third antenna 17 of the displacement sensor 8 (to be described later). The length of the slider 5 is greater than the stroke of the linear actuator. The slider 5 is made of a metal having a smooth surface, or resin. However, to obtain a light-weight actuator, resin is preferably used. Inside the slider 5 is formed a through hole whose cross section in the longitudinal direction is a circular shape. This hole is for accommodating the feed screw unit 3 and therefore, is slightly larger than the outer diameter of the feed screw 3. An article can be moved by connecting the article to this actuation unit 5. In addition, the slider 5 may have plural holes to which articles to be fed can be attached.

The feed nut unit 6 has a tubular shape and forms together with the feed screw unit 3 a power transmission mechanism. Its role is to convert a rotational motion into a linear motion. Screw grooves having the same pitch with the feed screw unit 3 are formed on the inner peripheral surface of the through hole of the feed nut unit 6 so that the feed screw unit 3 can be screwed thereto. The feed nut unit 6 is fixed in a manner that the center axis of the through hole of the slider 5 and the center axis of the through hole of the feed nut unit 6 coincide with each other on the end portion of the driving motor 1 side of the slider 5. Although the feed nut unit 6 can be made of a metal or resin, resin is preferably used to achieve a light-weight actuator. In addition, the slider 5 and the feed nut unit 6 can be molded together as one body. Also, a first stopper 11 (not shown in FIGS. 1 and 2 but will be described later with reference to FIG. 3), as a retaining means, is installed on the end portion opposite from the driving motor 1 of the feed screw unit 3.

Figure 3:
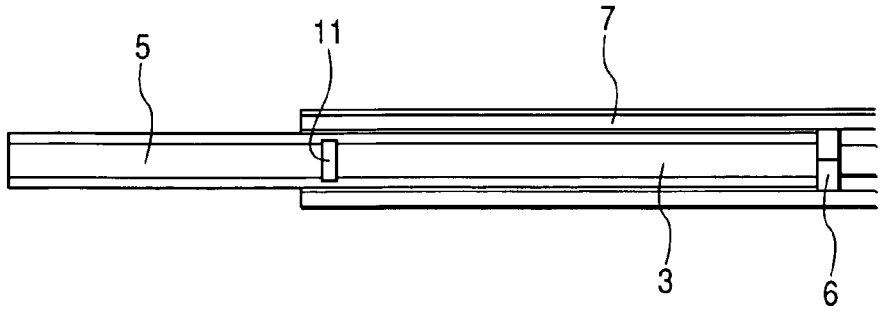
FIG. 3 is an enlarged view of a first stopper area in a linear actuator of the embodiment of FIG. 1.

FIG. 3 is an enlarge view of the first stopper 11 area.

As shown in FIG. 3, the outer diameter of the first stopper 11 is larger than the outer diameter of the screw hole of the feed nut unit 6, thereby having the slider 5 protrude to a great extent. This prevents the feed nut unit 6 from escaping from the feed screw unit 3. The guide 7 is extendably formed in the longitudinal direction of the actuator, and fixed to the base 9. The guide 7 has a recess whose cross-section has a U shape. By placing the slider 5 in this recess, the guide 7 hinders the rotation of the slider 5 along with the rotation of the driving motor 1 and at the same time guides the slider 5 to move in a straight line. Moreover, in order to reduce the frictional force between the guide 7 and the slider 5, the recess of the guide 7 is slightly wider than the slider 5. Desirably, the guide 7 is made of an insulating material, a resin for example, to be installed together with the displacement sensor 8.

Although the above described the guide 7 as a member having a recess whose cross section has a U shape, any shape can be used as long as it can impede the rotation of the slider 5 along with the rotation of the driving motor 1 and make the slider 5 move in a straight line. For example, a tubular shape encompassing the outer peripheral of the slider 5 can also be used. The displacement sensor 8 is installed on the slider 5 and the guide 7, and measures a displacement amount of the slider 5. More details will be provided later.

The following now explains why the displacement sensor 8 is installed on the linear actuator of the present invention. The linear actuator of the invention is primarily used to execute position control of the slider 5 based on a displacement direction and a displacement amount of the slider 5 obtained by an external sensor or an external input means. In addition, as described before, a DC brush motor is used to realize a low-price driving motor 1. In effect, the displacement sensor 8 for position control is not required if an expensive stepping motor or a DC brushless motor is used as the driving motor 1, but the DC brush motor is not designed for position control. This is because the revolutions per minute of the motor vary by an external load of the linear actuator. Therefore, the linear actuator of the invention is provided with the displacement sensor 8 for executing position control of the slider 5. Further description on the displacement sensor 8 detecting a displacement amount of the slider 5 will be provided with reference to FIG. 4.

Figure 4:
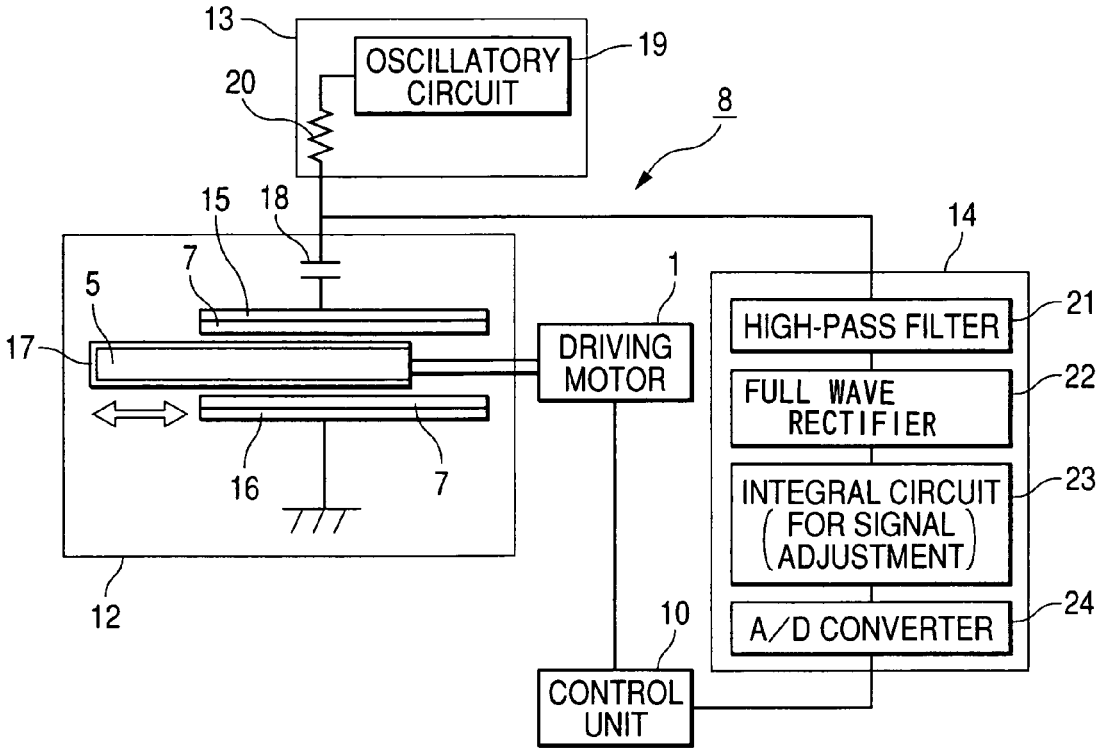
FIG. 4 illustrates the constitution of a displacement sensor in a linear actuator of the embodiment of FIG. 1.

FIG. 4 shows a constitution of the displacement sensor 8 installed on the linear actuator. As shown in FIG. 4, the displacement sensor 8 includes a detecting unit 12 mounted on the main body of the linear actuator, an input signal unit 13 applying a signal to the detecting unit 12, and a signal processing unit 14 processing an output signal from the detecting unit 12. The detecting unit 12 includes a first antenna 15, a second antenna 16 arranged on an outer side of the guide 7 opposite to the first antenna 15 arranged on the other outer side of the guide 7, a third antenna 17 arranged on the outer peripheral of the slider 5 opposing the first antenna 15 and the second antenna 16, and a condenser 18 removing a DC component of a signal. The input signal unit 13 includes an oscillatory circuit 19 applying a radio frequency sine wave to the first antenna 15, and a resistor 20 connected between the oscillatory circuit 19 and the first antenna 15. The signal processing unit 14 includes a high-pass filter 21 passing only signals of a predetermined frequency or higher, a full wave rectifier 22 for detecting all waves that obtains absolute values of signals and rectifies signals, an integral circuit 23 executing gain adjustment and offset adjustment, and an A/D converter 24 converting an analog signal into a digital signal. The first antenna 15, the second antenna 16, and the third antenna 17 are installed in a way that the antenna surfaces are parallel with one another, and an insulator is inserted therebetween so that the antennas do not come in contact with each other. To this end, a condenser is formed by the first antenna 15 and the third antenna 17, and by the second antenna 16 and the third antenna 17.

Therefore, to form a condenser by the antennas, the guide is formed of an insulator. In addition, the first antenna 15, the second antenna 16, and the third antenna 17 have the same width, and they are installed so that their width directions (depth direction in FIG. 4) are always coincident. The third antenna 17 is installed on three outer peripheral surfaces except for the surface where the feed nut unit 6 of the slider 5 is installed. In this way, the surface of the third antenna 17 facing the first antenna 15 and the other surface of the third antenna 17 facing the second antenna 16 have the same potential. In so doing, capacitance between the first antenna 15 and the second antenna 16 is increased and therefore, the detection sensitivity of the displacement sensor 8 is improved. In the first antenna 15, the input signal unit 13 and the signal processing unit 14 are connected by the condenser 18, and the second antenna 16 is grounded.

Since the third antenna 17 is installed on the slider 5, it moves together with the slider 5 in the longitudinal direction of the linear actuator. In the case that a wire is connected to the third antenna 17, the wire may be broken as the slider 5 moves. Thus, no wiring is done for the third antenna 17, and the third antenna 17 is electrically floated. Although the first antenna 15, the second antenna 16, and the third antenna 17 are conductors, such as, copper foils, other things may also be used as long as they generate the same effect. Considering that a compact linear actuator is to be built, those antennas are desirably formed of thin sheet-type conductors. As the antenna conductors' areas increase, capacitances thereof increase and the detection sensitivity of the displacement sensor 8 is improved. Thus, the greater the area of the respective antennas, the better. Each constituent of the displacement sensor 8, i.e., the condenser 18, the resistor 20, the oscillatory circuit 19, the high-pass filter 21, the full wave rectifier 22, the integral circuit 23, and the A/D converter 24 are all mounted on the same circuit board. In the case that the first antenna 15 is installed away from the condenser 18, a shield wire is used to connect the first antenna 15 and the condenser 18, so as to get rid of any influence of noises from outside.

Therefore, since the linear actuator only needs to install the thin conductors which are the first antenna 15, the second antenna 16, and the third antenna 17, the linear actuator can be made small. Although a well-known potentiometer may be used as the displacement sensor 8, the potentiometer is not recommended because it only makes the linear actuator bulky. The oscillatory circuit 19 is connected to the first antenna 15 by the resistor 20 and the condenser 18 therebetween, and generates radio frequency sine waves. In effect, the condenser 18 is not an essential element for the actuator, so it can be removed if desired. The displacement sensor 8 measures potential between the condenser 18 and the resistor 20 with output voltage. This output voltage is processed at the signal processing unit 14, and sent to the control unit 10. An input side of the high-pass filter 21 for removing low frequency noises is connected to the condenser 18, and an output side thereof is connected to the full wave rectifier 22. Since it is good to send a signal within an oscillating frequency range of the oscillatory circuit 19 to the full wave rectifier 22, the displacement sensor 8 ensures that all low frequency noises are removed by the high-pass filter 21.

An input side of the full wave rectifier 22 is connected to the high-pass filter 21, and an output side thereof is connected to the integral circuit 23. A signal from the high-pass filter 21 is a sine wave oscillating between plus range and minus ranges. Before inputting a signal to the A/D converter 24, the full wave rectifier 22 takes an absolute value of a signal within a minus range to a plus range. Moreover, the full wave rectifier 22 rectifies the signal. Meanwhile, an input side of the integral circuit 23 is connected to the full wave rectifier 22, and an output side thereof is connected to the A/D converter 24. The integral circuit 23 executes offset adjustment and gain adjustment on a signal from the full wave rectifier 22. The offset adjustment and the gain adjustment are for adjusting the output sensitivity of the displacement sensor 8 that is set to increase the detection sensitivity.

An input side of the A/D converter 24 is connected to the integral circuit 23, and an output side thereof is connected to the control unit 10 of the linear actuator. The A/D converter 24 converts an analog signal from the integral circuit 23 into a digital signal. The control unit 10 is connected to the A/D converter 24 and the driving motor 1, and calculates a displacement amount based on a signal from the A/D converter 24. Also, the control unit 10 acquires information about displacement direction and displacement amount of the linear actuator from a sensor or an input means of the outside. Based on the displacement direction and displacement amount, and the detection result from the displacement sensor 8, the control unit 10 controls the rotational direction and ON/OFF of the driving motor 1.

The following now describes the principle of measurement of the displacement sensor 8. In the detecting unit 12 of the displacement sensor 8, three condensers are formed by the first antenna 15, the second antenna 16, and the third antenna 17. That is, a condenser C1 is formed by the first antenna 15 and the third antenna 17, a condenser C2 is formed by the second antenna 16 and the third antenna 17, and a condenser C3 is formed by the first antenna 15 and the second antenna 16, respectively. In general, capacitance C(F) is obtained by Equation 1 below.

$$C=\epsilon\cdot S/d \qquad \text{[Equation 1]}$$

where, $\epsilon$ (F/m) indicates a dielectric constant, S (m2) indicates an area of an opposite antenna, and d (m) indicates a distance between antennas opposite to each other. As seen in Equation 1, if the distance d between antennas opposite to each other is fixed, the capacitance C is proportional to the dielectric constant $\epsilon$ and the area S of an opposite antenna. Since the first antenna 15, the second antenna 16, and the third antenna 17 are arranged on planes parallel with one another and have the same width in the longitudinal direction, respectively, the capacitance in the condenser C1 for example increases proportionally to an overlapped length between the first antenna 15 and the third antenna 17. This equally happens in the second condenser C2 and the third condenser C3. Since capacitances C1, C2 and C3 are changed by the linear motion of the slider 5, the output voltage between the resistor 20 and the condenser 18 changes. This output voltage is processed by the signal processing unit 14 and the control unit 10 calculates a position of the guide 7 of the slider 5. In addition, the length of an antenna becomes the measurement range of the displacement sensor 8. In other words, the longer the antenna, the greater the measurement range. Therefore, antennas are arranged on the overall surface in the longitudinal direction of the guide 7 and the slider 5. The detection sensitivity of the displacement sensor 8 is improved as a difference increases between the output voltage in the case the slider 5 is lead in closest to the driving motor 1 and the output voltage in the case that the slider 5 is protruded the most.

Since capacitances of the condensers C1, C2 and C3 formed by the first antenna 15, the second antenna 16, and the third antenna 17 are small, frequency of the oscillatory circuit 19 should be large to make the impedances of these condensers C1, C2 and C3 small. However, if the frequency is too large, the output voltage is small. Thus, it is necessary to adjust the frequency. For instance, a proper frequency of the oscillatory circuit 19 is around 800 kHz. In this manner, the displacement sensor 8 is able to detect a displacement amount of the slider 5. The detecting unit 12 may be installed on the linear actuator by other methods, the method of FIGS. 5 to 7 for example, besides the one shown in FIG. 4.

Figure 5:
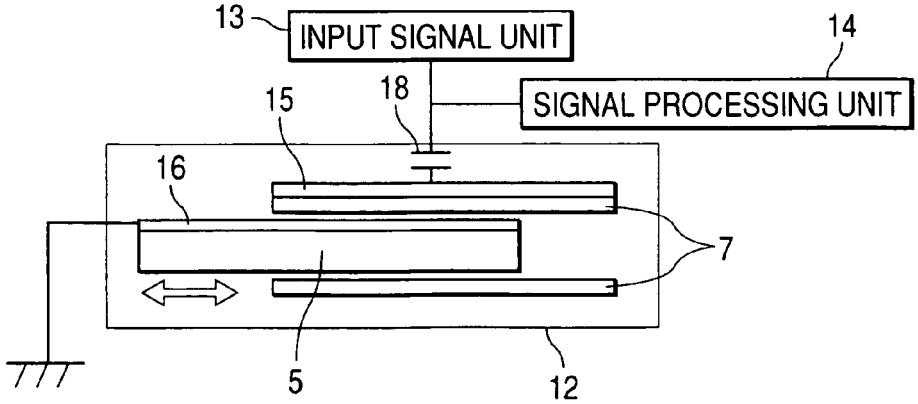
FIG. 5 shows another example of the constitution of a detecting unit.
Figure 6:
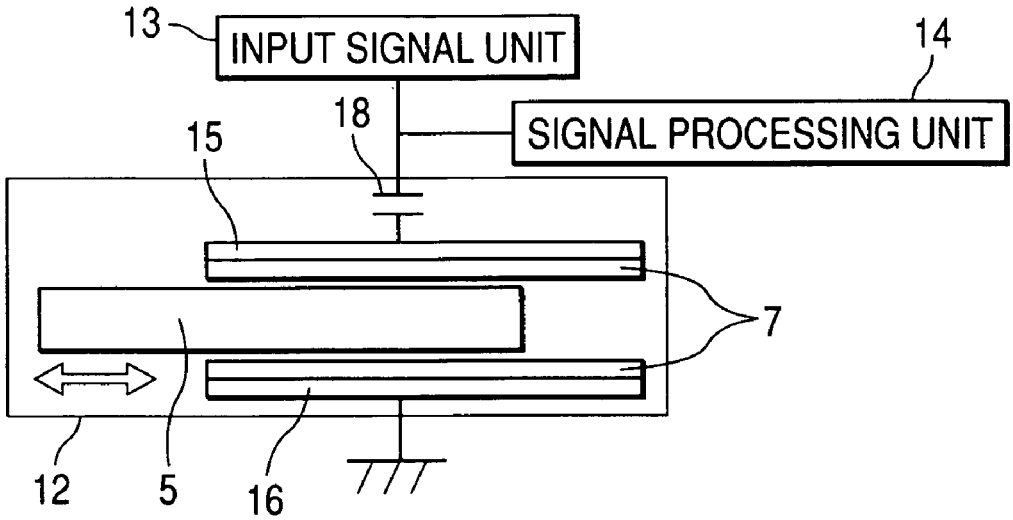
FIG. 6 shows still another example of the constitution of a detecting unit.
Figure 7:
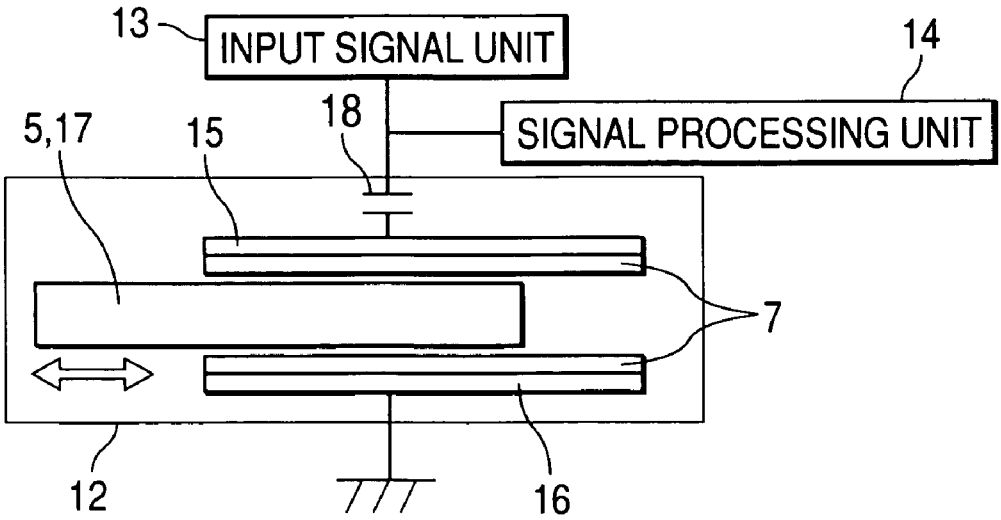
FIG. 7 shows still another example of the constitution of a detecting unit.

The following now describes an installation method of the detecting unit 12 with reference to FIGS. 5 to 7.

Referring to FIG. 5, the first antenna 15 is arranged on the outside face of the guide 7 and the second antenna 16 is arranged on the slider 5, on the side where the first antenna 15 is arranged.

In FIG. 5, the input signal unit 13 and the signal processing unit 14 are connected to the first antenna 15 with the condenser 18 therebetween, and the second antenna 16 is grounded. The second antenna 16 may be grounded using a wire or a grounding member (not shown) such as a conductive brush provided on the guide 7. In case of connecting a wire to the second antenna 16, it is proper for a linear actuator wherein the length of the wire falls within a range of stroke that does not influence the operation of the linear actuator. In case of grounding the second antenna 16 by a grounding member such as a brush, it is proper for a linear actuator whose driving motor's torque has a margin and the influence of a frictional load between the slider 5 and the guide 7 is small. As for the installation of the detecting unit 12 shown in FIG. 5, a condenser C4 is formed by the first antenna 15 and the second antenna 16. Since the overlapped area between the first antenna 15 and the second antenna 16 varies by the movement of the slider 5, capacitance of the condenser C4 changes. In this manner, the detecting unit 12 can detect a displacement amount of the slider 5. In addition, the reason for installing the second antenna 16 on the side of the first antenna 15 of the slider 5 is to increase capacitance of the condenser C4.

Referring next to FIG. 6, the first antenna 15 is arranged on an outer surface of the guide 7 while the second antenna 16 is arranged on the outer surface on the other side of the guide 7. Here, the slider 5 is an insulator.

In FIG. 6, the input signal unit 13 and the signal processing unit 14 are connected to the first antenna 15 by the condenser 18 therebetween, and the second antenna 16 is grounded. According to the installation method of the detecting unit 12 shown in FIG. 6, a condenser C5 having the slider 5 inserted between the first antenna 15 and the second antenna 16 and a condenser C6 without the slider 5 are formed. Since the electrode areas of the condenser C5 and the condenser C6 vary by the movement of the slider 5, capacitances of the condensers C5 and C6 change. In this manner, the detecting unit 12 is able to detect a displacement amount of the slider 5. Since capacitances of the condensers C5 and C6 are smaller than those shown in FIG. 4 and FIG. 5, this is suitable for a linear actuator which has a small actuation unit 5 and a small distance between the first antenna 15 and the second antenna 16.

Referring now to FIG. 7, the first antenna 15 is arranged on an outer surface of the guide 7 while the second antenna 16 is arranged on the outer surface on the other side of the guide 7. Here, the slider 5 is a conductor and third antenna 17 at the same time.

In FIG. 7, the input signal unit 13 and the signal processing unit 14 are connected to the first antenna 15 via the condenser 18, and the second antenna 16 is grounded. According to the installation method of the detecting unit 12 shown in FIG. 7, similar to the one shown in FIG. 4, a condenser C7 is formed by the first antenna 15 and the third antenna 17, a condenser C8 is formed by the second antenna 16 and the third antenna 17, and a condenser C9 is formed by the first antenna 15 and the second antenna 16. Since capacitances of the condensers C7, C8 and C9 change by the linear motion of the slider 5, the detecting unit 12 is able to detect a displacement amount of the slider 5. In this case, since the slider 5 is a conductor, its weight is increased. Therefore, this is suitable for a linear actuator in which the driving motor's torque has a margin and a light actuation unit 5 is not required.

So far, the installation method of the displacement sensor 8 at the linear actuator has been explained. However, such displacement sensor 8 may be installed on another instrument or different type of actuator and serve to detect a displacement amount of an actuating member.

As for the linear actuator of the present invention, a feed screw is used to convert the rotational motion of the driving motor 1 into the linear motion of the slider 5. This is to realize a compact linear actuator having a small outer diameter, whereby plural linear actuators can be arranged nearby or at a small distance away from each other. To achieve a compact linear actuator, it is necessary to reduce the size of the driving motor 1. However, if the size of the driving motor 1 is reduced, torque thereof is also reduced. Thus, to secure sufficient thrust for the linear actuator, the torque needs to be increased by a reduction gear. It turned out that the feed screw system not only reduced the size (outer diameter) of the linear actuator but also secured thrust therefor.

Also, to obtain a compact linear actuator, the base 9 and the driving motor holder 2 should not be larger than the outer diameter of the driving motor 1.

Figure 8:
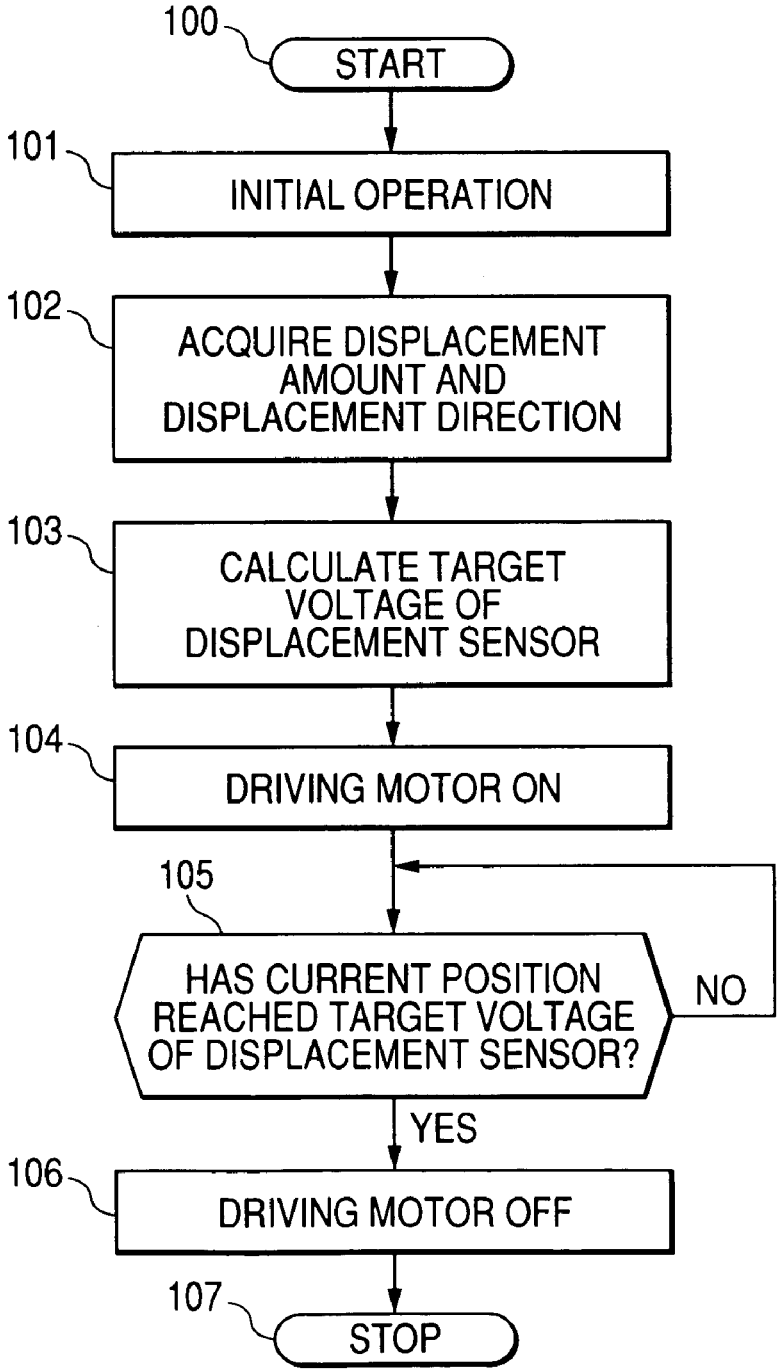
FIG. 8 is a flow chart explaining an operation of a linear actuator of the embodiment of FIG. 1.

With reference to the flow chart shown in FIG. 8, the following now describes the operation of the linear actuator.

Figure 9:
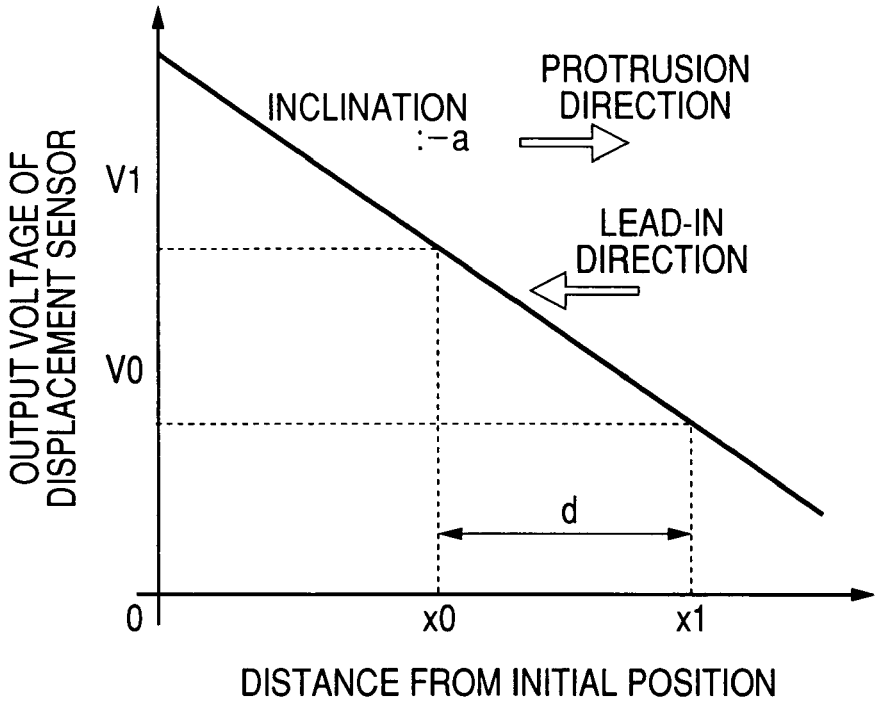
FIG. 9 graphically illustrates a relation between distance from the initial position of a slider and output voltage of a displacement sensor.

As shown in FIG. 8, in step S101, the slider 5 returns to its initial position by executing the initial operation of the linear actuator. At the initial position, the slider 5 is accommodated at the closest place to the driving motor 1. The driving motor 1 is driven to move the slider 5 towards the driving motor 1 and ultimately to the initial position. Whether the slider 5 reached the initial position or not is determined by checking whether the slider has touched the second stopper 25 and stopped. In addition, to detect the initial position of the slider 5, an optical detecting sensor (not shown) may be installed around the second stopper 25 and detect whether an optical axis of the detecting sensor has been cut off by the slider 5. Moreover, the most protruded location of the slider 5 may be set as the initial position. In step S102, displacement amount and displacement direction of the slider 5 are obtained. An operator may input these displacement direction and displacement amount from the outside, or the control unit 10 may obtain them from a sensor from the outside (not shown). In step S103, based on the displacement amount and the displacement direction obtained in step S102, a target voltage of the displacement sensor 8 is calculated. As depicted in FIG. 9, an output voltage of the displacement sensor 8 is in proportion to a distance from the initial position of the slider 5, and a target voltage V1 is calculated using the voltage V0 at the present position X0, the displacement amount d and the displacement direction. In the case that the slider 5 is protruded, the target voltage V1 can be obtained by Equation 2 below.

$$V1=-a\times d+V0 \quad \text{[Equation 2]}$$

Meanwhile, in the case that the slider 5 is lead in, the target voltage V1 can be obtained by Equation 3 below.

$$V1=-a\times(-d)+V0 \quad \text{[Equation 3]}$$

The reason for using Equations 2 and 3 to calculate the target voltage is because the output voltage of the displacement sensor 8 is sometimes offset by its surrounding environment. Next, in step S104, the driving motor 1 is ON by rotating the driving motor 1 forward or backward according to the displacement direction obtained in step S102. In consequence, the output shaft of the driving motor 1 and the feed screw unit 3 rotate as one body. Moreover, the displacement direction of the slider 5 can be changed by the rotational direction of the driving motor 1. Because the feed nut unit 6 screwed to the feed screw unit 3 is fixed to the slider 5 as described above and because the slider 5 does not rotate by the guide 7, the feed nut unit 6 does not rotate. Instead, the feed nut unit 6 and the slider 5 start a linear motion. Later, in step S105, it is determined whether the slider 5 has reached its target position. This is accomplished by comparing a current output voltage of the displacement sensor 8 with the target voltage V1 calculated in step S103. If the output voltage of the displacement sensor 8 and the distance from the initial position of the slider 5 satisfy the relation shown in FIG. 9, to move the slider 5 in the protrusion direction, it is determined that target position has been attained when the current output voltage is below the target voltage V1. In addition, to move the slider 5 in the lead-in direction, it is determined that target position has been attained when the current output voltage is above to the target voltage V1.

If, in step S105, it is determined that the output voltage of the displacement sensor 8 reached the target voltage V1, the driving motor 1 stops running (S106). On the other hand, if, in step S105, it is determined that the output voltage of the displacement sensor 8 does not rech the target voltage V1, the driving motor 1 keeps running until the target voltage V1 is obtained. As the gap between decision making steps is short, the detection precision of the displacement amount of the linear actuator is high. As described above, the linear actuator of the present invention controls ON/OFF of the driving motor 1 based on the information from the displacement sensor 8, and therefore executes position control of the slider 5. Moreover, by changing the length of the feed screw unit 3, actuation unit 5 and guide 7, the stroke of the linear actuator can be modified. The detection of the initial position of the slider 5 in step S101 may also be accomplished by the following method.

Figure 10:
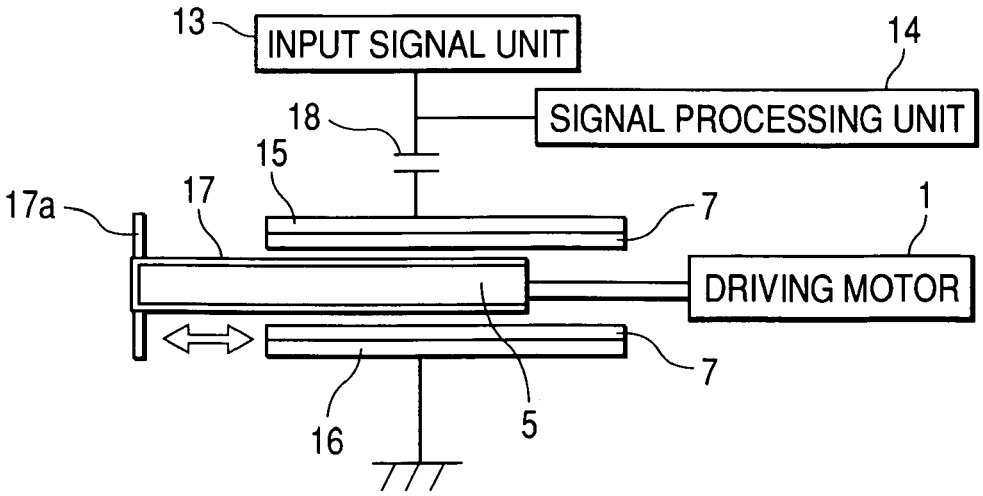
FIG. 10 illustrates a constitution of a linear actuator for detecting the initial position of a slider using a separate method.

As shown in FIG. 10, a third antenna 17*a* is arranged on the end portion of the slider 5 opposite to the driving motor 1. This is an extended form of the third antenna 17 in the vertical direction. When the slider 5 returns to the initial position, the third antenna 17*a* is connected to the first antenna 15 and the second antenna 16. Then the output voltage of the displacement sensor 8 becomes zero. In such case, it is determined that the slider 5 has reached its initial position. To detect the initial position, the method used in step S103 for obtaining the target voltage has to be changed. After driving the driving motor 1 for a short amount of time, the target voltage V1 is calculated by utilizing the Equations 2 or 3. This is possible because the output voltage of the displacement sensor 8 is zero when the slider 5 is at its initial position. Moreover, it is necessary to correct the displacement amount of the slider 5 when the driving motor 1 is driven for a short amount of time. Although the initial operation is to be executed in step S101, in the case that the current position of the slider 5 is known by driving the actuator repeatedly, step S101 may be omitted. The following now describes a second embodiment of the linear actuator of the invention.

Embodiment 2

Figure 11:
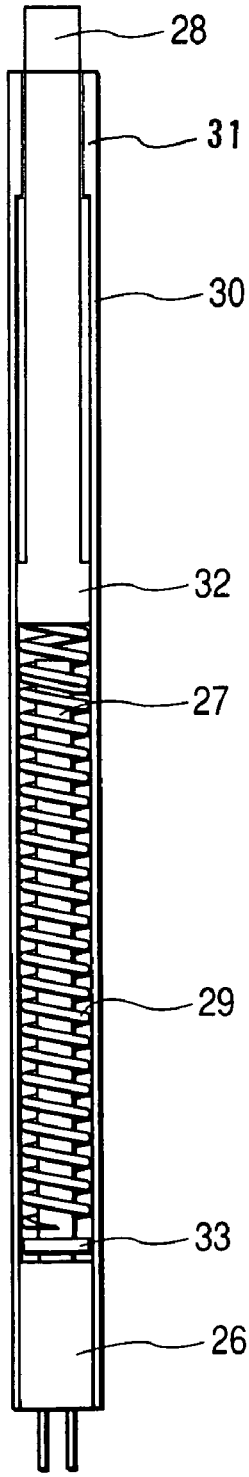
FIG. 11 is a front view illustrating a constitution of a linear actuator according to a second embodiment of the present invention.

FIG. 11 is a front view illustrating a constitution of a linear actuator according to the second embodiment of the present invention.

Figure 12:
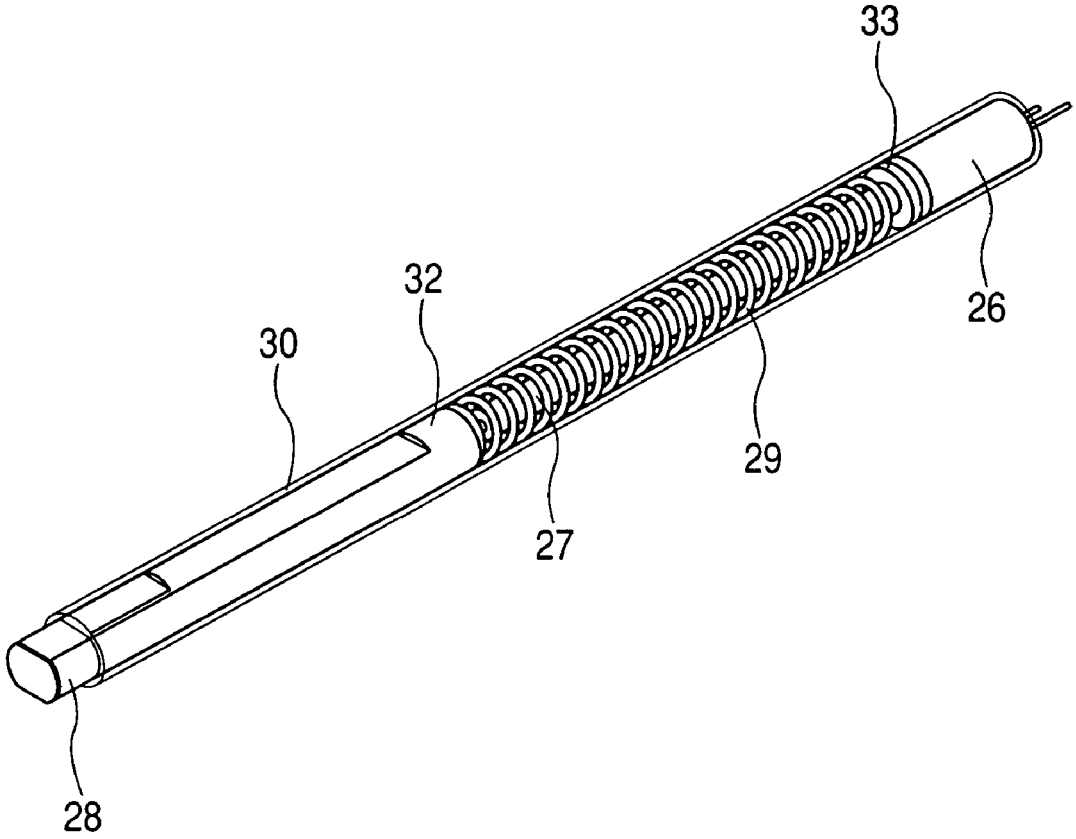
FIG. 12 is a perspective view of the embodiment of FIG. 11.

FIG. 12 is a perspective view of the embodiment of FIG. 11.

Figure 13:
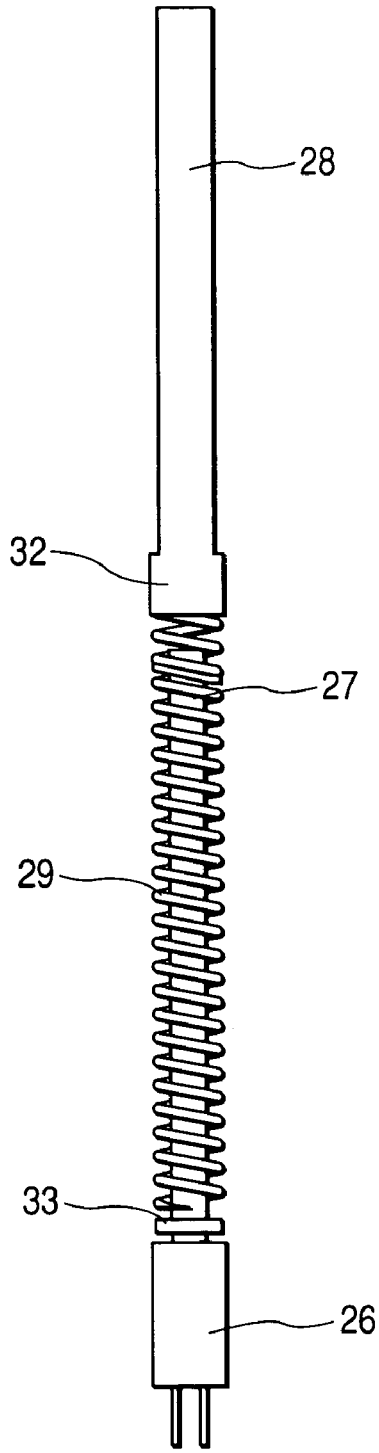
FIG. 13 is a front view of the embodiment of FIG. 11 without a guide.

FIG. 13 is a front view of the embodiment of FIG. 11 without a guide 30 (to be described later).

Figure 14:
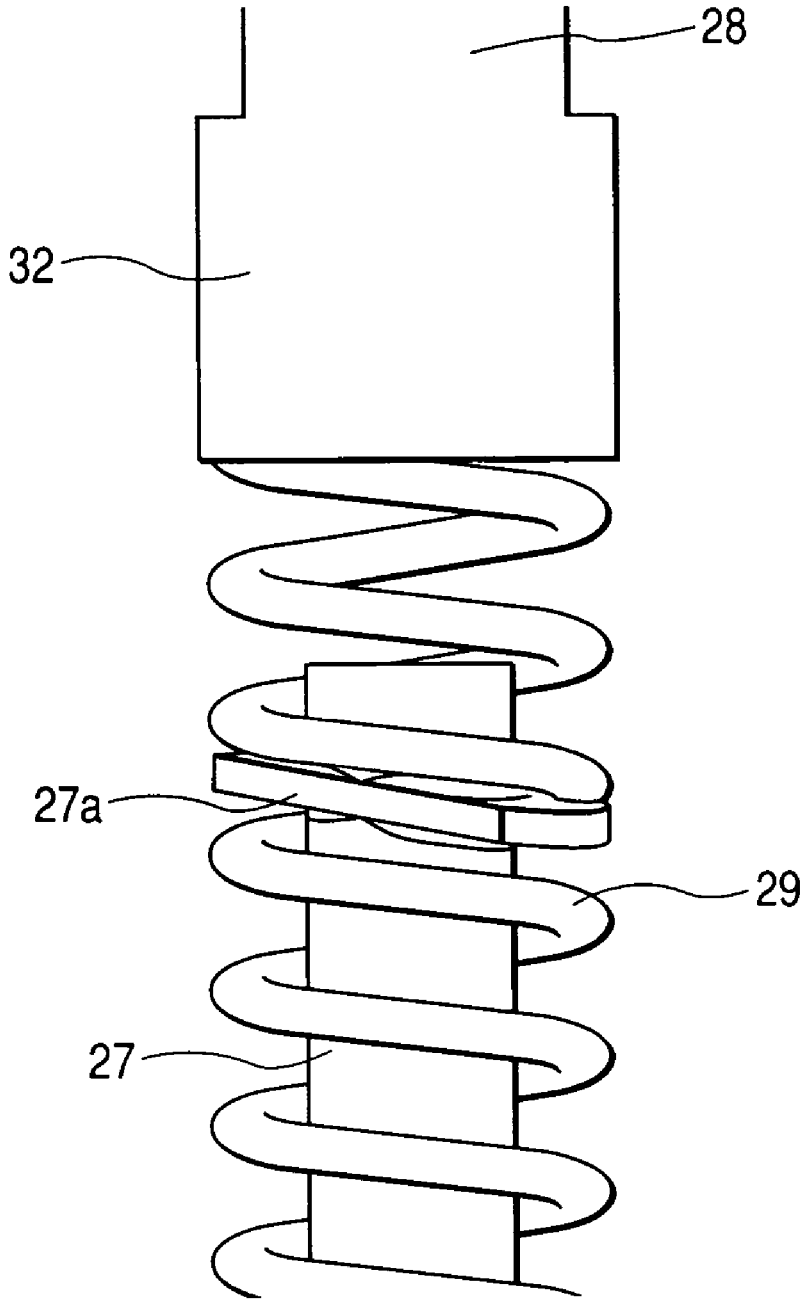
FIG. 14 is an explanatory diagram showing the installation of a rotating bar and a spiral spring.

FIG. 14 is an explanatory diagram showing the assembly of a rotating bar and a spiral spring. In FIGS. 11 to 14, reference numeral 26 denotes a driving motor, the driving power source of a slider 28. Reference numeral 27 denotes a rotating bar connected to the driving motor 26, and therefore rotates together with the driving motor 26. Reference numeral 29 denotes a spiral spring, which is screwed to the rotating bar 27 moving straightly to move an article for example and converts a rotational motion into a linear motion. Reference numeral 30 denotes a guide guiding the slider 28 to move in a straight line. Explanations on the displacement sensor 8 and the control unit 10 are omitted because they are identical with those in the first embodiment.

Similar to the first embodiment, a DC brush motor is used as the driving motor 26. Although a stepping motor offering easy position control or a DC brushless motor may be used as the driving motor 26, an inexpensive DC brush motor is preferred for the sake of saving cost. In addition, to increase thrust of the linear actuator, a reduction gear may be attached to the driving motor 26. To realize a compact linear actuator, however, the outer diameter of the reduction gear must be smaller than the outer diameter of the driving motor 26. The rotating bar 27 is a member having propeller shaped wings on its end portion. The rotating bar 27 is connected to the output shaft of the driving motor 26, and the center axis of the output shaft of the driving motor 26 and the center axis of the rotating bar 27 are arranged on the same line. The rotating bar 27 connected to the driving motor 26 rotates together with the output shaft of the driving motor 26 as one body.

As shown in FIG. 14, a blade 27*a* is installed to fit in a gap of the spiral spring 29 wound in a spiral shape. To make the interfacial surface between the spring 29 smooth, the a blade 27*a* is inclined by a predetermined angle with respect to the center axis. Moreover, the length of the rotating bar 27 in the longitudinal direction is greater than the stroke of the slider 28. The rotating bar 27 is made of hard metals, stainless steel for example, so that it may not be easily bent. The slider 28 has a tubular shape, not a circular cylindrical shape, and at least one surface thereof is planar.

The slider 28 shown in FIGS. 11 and 12 has two planar surfaces in order to install a third antenna 17 of the displacement sensor 8. The length of the slider 28 is greater than the stroke of the linear actuator. The slider 28 is made of a metal having a smooth surface, or resin. However, to obtain a lightweight actuator, resin is preferably used. An article can be moved by connecting the article to this actuation unit 28. In addition, the slider 28 may have plural holes to which articles to be fed can be attached. The spiral spring 29, together with the rotating bar 27, is a power transmission mechanism and is in charge of converting a rotational motion into a linear motion. A compressing spring for example is used as the spiral spring 29. As aforementioned, the rotating bar 27 is combined with the spiral spring 29. Even though the slider 28 is installed on the end portion of the spiral spring 29, it is not fixed thereto.

In general, thrust of the linear actuator increases as the number of turns in the spiral spring 29 increases and the pitch decreases, while the speed of the slider 28 slows down. A proper pitch needs to be set according to specifications required of a linear actuator. The guide 30 is a cylindrical shaped member, and the driving motor 26, the rotating bar 27, the slider 28 and the spiral spring 29 is arranged in a straight line. Thus the slider 28 and the spiral spring 29 move in a straight line. The inner diameter of the guide 30 coincides with the outer diameter of the driving motor 26, and the driving motor 26 is fixed to the end portion of the guide 30. The inner diameter of the guide 30 and the outer diameter of the spiral spring 29 are adjusted to cause a frictional force sufficient for suppressing the rotation around the output shaft of the driving motor 26 can be applied to the spiral spring 29.

Figure 15:
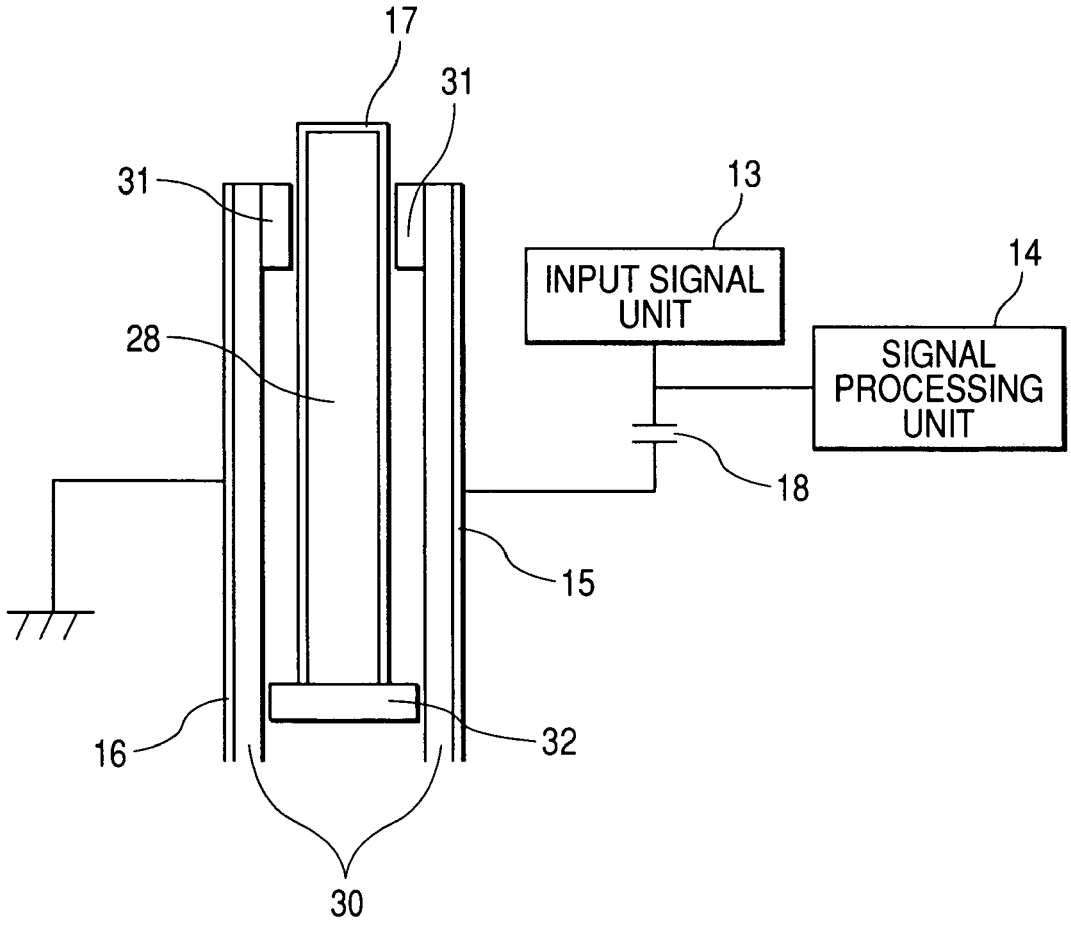
FIG. 15 is an explanatory diagram showing the installation of a displacement sensor in a linear actuator of the embodiment of FIG. 11.

In the case that the frictional force between the spiral spring 29 and the guide 30 is too small, the spiral spring 29 rotates along with the rotating bar 27. In other words, the spiral spring 29 does not produce the linear motion in the longitudinal direction of the linear actuator. Similarly, if the frictional force is too great, the spiral spring 29 cannot produce the linear motion. In addition, in order to allow the rotating bar 27 to rotate without contacting the guide 30, the outer diameter of a blade 27*a* of the rotating bar 27 is slightly smaller than the inner diameter of the guide 30. As shown in FIG. 15, a rotation stopping unit 31 is formed at the other end portion of the guide 30 where the driving motor 26 is not installed. The rotation stopping unit 31 has a planar surface to come in contact with the planar surface of the slider 28, and obstructs the rotation of the slider 28 along with the rotation of the driving motor 26. To help the slider 28 move smoothly, there is a little space between the slider 28 and the rotation stopping unit 31. For the installation of the displacement sensor 8, the guide 30 is desirably formed of an insulator, a resin for example. The guide 30 and the rotation stopping unit 31 may be molded as one body. A first stopper 32 is installed on the end portion of the side of the driving motor 26 of the slider 28. The first stopper 32 has a cylindrical shape, and its outer diameter is slightly smaller than the inner diameter of the guide 30.

Now that the first stopper 32 comes in contact with the rotation stopping unit 31, the slider 28 is not easily escaped from the guide 30. In addition, the slider 28 and the first stopper 32 may be molded as one body. Meanwhile, a second stopper 33 is formed at the end portion of the side of the driving motor 26 of the rotating bar 27. The second stopper 33 has a cylindrical shape and its outer diameter is slightly smaller than the inner diameter of the guide 30. The spiral spring 29 moves vertically driven by the driving motor 26. The second stopper 33 serves to limit the movement of the spiral spring 29 in the lower direction. In short, the linear actuator according to the second embodiment of the present invention utilized the rotating bar 27 and the spiral spring 29 instead of a typical feed screw. Also, the stroke of the linear actuator can be changed by changing sizes of the rotating bar 27, actuation unit 28, spiral spring 29 and guide 30.

Referring to FIG. 15, the following now describes the installation method of the displacement sensor 8 at the linear actuator according to the second embodiment of the present invention.

As shown in FIG. 15, a first antenna 15 is arranged on the outside of the guide 30 and a second antenna 16 is arranged on the outside of the guide 30 opposing the first antenna 15.

Meanwhile, as shown in the drawing, a third antenna 17 is arranged on three parts of the outer peripheral surface of the slider 28, respectively. For the installation of the first antenna 15 and the second antenna 16, the outer peripheral of the guide 30 has planar surfaces. These surfaces are in parallel with the rotation stopping unit 31 as well as the third antenna 17 installed on the slider 28. An input signal unit 13 and a signal processing unit 14 are connected to the first antenna 15 via a condenser 18, and the second antenna 16 is grounded. Since the third antenna 17 is installed on the slider 28, it moves along with the slider 28 in the longitudinal direction of the linear actuator. In the linear actuator according to the second embodiment of the present invention, the rotating bar 27 rotates driven by the driving motor 26, and this rotation causes the spiral spring 29 to move in the longitudinal direction of the linear actuator, thereby moving the slider 28. Because the control method is the same as the first embodiment, explanation thereof is omitted.

Next, the initial operation of the slider 28 is described. An initial position of the slider 28 is the closest place to the driving motor 26. The driving motor 26 is driven to move the slider 28 towards the driving motor 26 and ultimately to the initial position. Whether the slider 28 reached the initial position or not is determined by checking whether the spiral spring 29 has touched the second stopper 33 and stopped. The detection of the initial position of the slider 28 may also be achieved by the following method.

Figure 16:
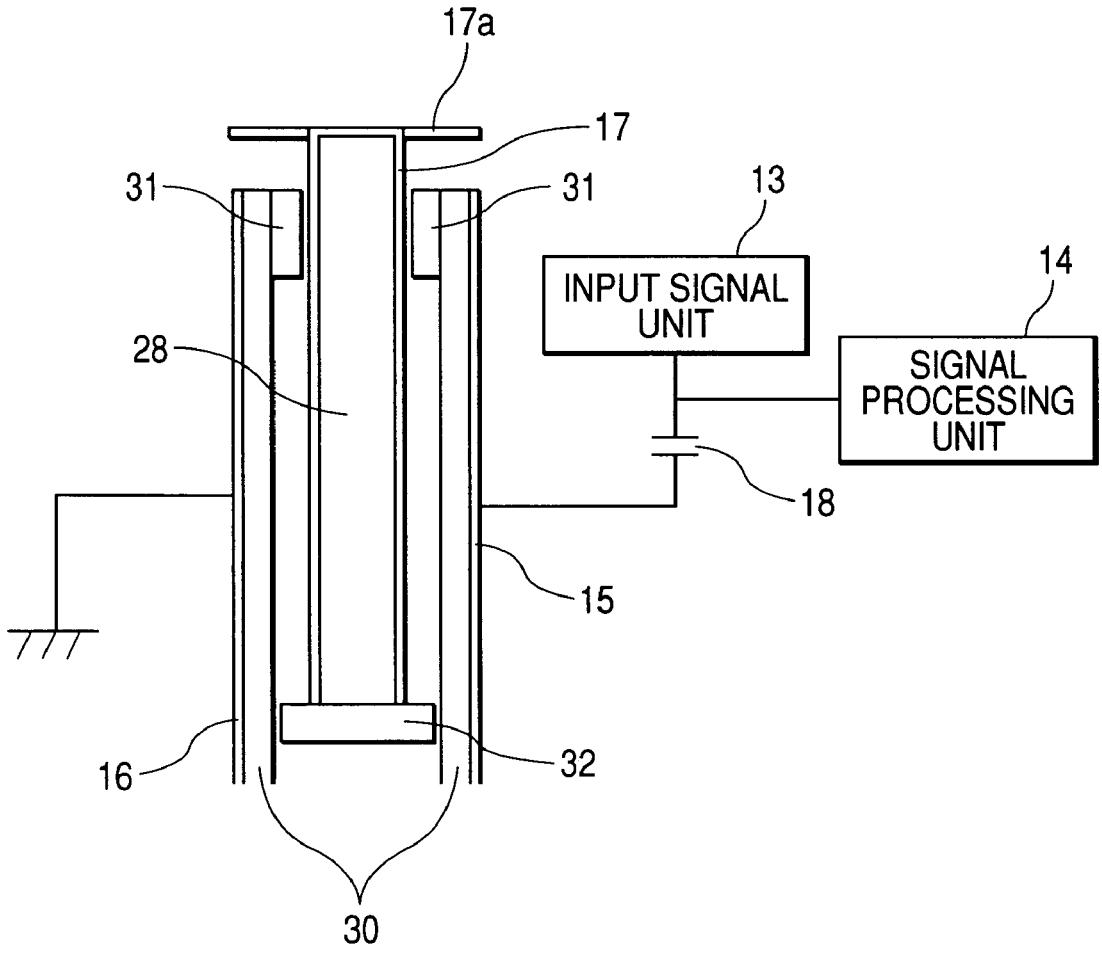
FIG. 16 illustrates a constitution of a linear actuator of the embodiment of FIG. 11 for detecting an initial position of a slider with a different method.

As shown in FIG. 16, a third antenna 17*a* is arranged on the end portion of the slider 28 opposite to the driving motor 26. This is an extended form of the third antenna 17 in the horizontal direction. When the slider 28 reaches the initial position on the side of the driving motor 26, the third antenna 17 comes in contact with the first antenna 15 and the second antenna 16. Therefore, when the slider 28 is led in the most towards the driving motor 26, the first antenna 15 and the third antenna 17*a*, and the second antenna 16 and the third antenna 17*a* contact with each other, thereby making the output voltage of the displacement sensor 8 zero. When the output voltage of the displacement sensor 8 is zero, it is determined that the slider 5 has reached the initial position.

Similar to the first embodiment, the method for calculating a target voltage has to be changed to detect the initial position. After driving the driving motor 26 for a short amount of time, the target voltage V1 is calculated by utilizing the Equations 2 or 3. This is possible because the output voltage of the displacement sensor 8 is zero at the initial position. Moreover, it is necessary to correct the displacement amount of the slider 26 when the driving motor 26 is driven for a short amount of time. Although in this embodiment the initial position was set to a position where the slider 28 is the closest to the driving motor 26, the most protruded position of the slider 28 can also be set as the initial position. In addition, the linear actuator according to the second embodiment of the present invention is able to measure an external force applied to the slider 28 by utilizing the spiral spring 29 and the displacement sensor 8.

The following describes a method for measuring an external force. In the case that an external force is applied to the slider 28 in the direction of the driving motor 26, provided that the driving motor 26 is off, the height of the spiral spring 29 shrinks. If the spring constant for the spiral spring 29 is known, the external force can be calculated based on a displacement amount of the length of the spring measured by the displacement sensor 8.

In this way, the linear actuator of the second embodiment can be used as a sensor for detecting an external force.

In conclusion, the compact, high-precision linear actuator is achieved by installing the small-sized displacement sensor.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A linear actuator, comprising:

a screw unit rotatably driven by a driving motor;

a nut unit screwed to the screw unit;

a slider attached to the nut unit, in which the slider and the nut unit move linearly by the rotation of the screw unit;

a guide restricting both surfaces of the slider;

a first antenna attached to a side wall of the guide opposite to the slider;

a second antenna attached to a side wall of the guide opposite to the slider, and opposing the first antenna; and a third antenna attached to both side walls of the slider, interposed between the first antenna and the second antenna, wherein the position of the slider is detected based on a change in capacitance due to displacement of the third antenna with respect to the first antenna and the second antenna.

2. The linear actuator according to claim 1, wherein the second antenna is grounded, and the linear actuator further comprises an oscillatory circuit for applying a radio frequency AC voltage to the first antenna, a resistor connected between the oscillatory circuit and the first antenna, a signal processing circuit for processing a signal from the first antenna, and a control unit for calculating the position of the slider based on the signal from the signal processing circuit, and controlling the drive of the driving motor.

3. The linear actuator according to claim 1, wherein capacitance of a first condenser formed by the first antenna and the third antenna, capacitance of a second condenser formed by the second antenna and the third antenna, and capacitance of a third condenser formed by the first antenna and the second antenna change by a movement of the slider, and the position of the slider with respect to the guide is calculated by detecting a change in the AC voltage from the oscillatory circuit applied to the first antenna.

4. The linear actuator according to claim 1, wherein the third antenna is formed of a conductor being bent to oppose the first antenna and the second antenna in continuation.

5. A linear actuator, comprising:

a rotating bar driven by a driving motor;

a spiral spring screwed to the rotating bar;

a slider attached to the spiral spring;

a guide accommodating the slider and the spiral spring, wherein the spiral spring and the slider move linearly inside the guide by the rotation of the rotating bar;

the linear actuator further comprising:

a first antenna installed in a longitudinal direction of the guide;

a second antenna, which is installed on the guide opposing the first antenna and which is grounded;

a third antenna attached to the slider opposing the first antenna and the second antenna;

an oscillatory circuit for applying a radio frequency AC voltage to the first antenna;

a resistor connected between the oscillatory circuit and the first antenna;

a signal processing circuit processing a signal from the first antenna; and a control unit for calculating the position of the slider based on the signal from the signal processing circuit and controlling the drive of the driving motor.

6. The linear actuator according to claim 5, wherein the linear actuator detects a displacement amount of the slider with respect to the guide in the case where the driving motor is OFF, and calculates an external force applied to the slider from the displacement amount and the spring constant of the spiral spring.

* * * * *